US006148450A

United States Patent [19]

Nicholas

[11] Patent Number: 6,148,450

[45] Date of Patent: Nov. 21, 2000

[54] PORTABLE STEAM BATH ASSEMBLY

[76] Inventor: Valentine J. Nicholas, 11155 Steeple Park Dr. #704, Houston, Tex. 77065

[21] Appl. No.: 09/314,900

[22] Filed: May 20, 1999

[51] Int. Cl.[7] ..... A61H 33/06

[52] U.S. Cl. ..... 4/526; 4/524; 4/527; 4/532; 4/599; D24/202; 607/81; 607/83; 607/84

[58] Field of Search ..... 4/524, 525, 526, 4/527, 528, 529, 530, 531, 532, 533, 534, 535, 536, 537, 584, 585, 586, 587, 589, 599, 612, 614; D24/202, 203, 204; 607/81, 83, 84; 135/139, 143

[56] References Cited

U.S. PATENT DOCUMENTS

| | | | |
|---|---|---|---|
| 548,641 | 10/1895 | Hollem | 4/527 |
| 2,725,577 | 12/1955 | Howard | 4/532 |
| 2,873,453 | 2/1959 | Kirschner | 4/527 |
| 3,092,843 | 6/1963 | Wright | 4/527 |
| 3,293,664 | 12/1966 | Coons | 4/599 |
| 3,351,957 | 11/1967 | Ikeda | 4/526 |
| 3,624,844 | 12/1971 | Sharps | 4/527 |

FOREIGN PATENT DOCUMENTS

| | | | |
|---|---|---|---|
| 72553 | 4/1985 | Japan | 4/524 |

*Primary Examiner*—Steven O. Douglas
*Assistant Examiner*—Khoa Huynh

[57] ABSTRACT

A portable steam bath assembly for providing an easily assembled lightweight portable steam bath assembly device. The portable steam bath assembly includes a frame, side and rear panels, a floor assembly, an outer cover, and a steam generating assembly.

20 Claims, 3 Drawing Sheets

PORTABLE STEAM BATH ASSEMBLY

BACKGROUND OF THE INVENTION

1. Field of the Invention

The present invention relates to steam bath devices and more particularly pertains to a new portable steam bath assembly for providing an easily assembled lightweight portable steam bath.

2. Description of the Prior Art

The use of steam bath devices is known in the prior art. More specifically, steam bath devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,092,843; U.S. Pat. No. 3,649,971; U.S. Pat. No. 3,875,596; U.S. Pat. No. 4,031,573; U.S. Pat. No. 1,464,093; and U.S. Patent No. Des. 326,720.

While these devices fulfill their respective, particular objectives and requirements, the aforementioned patents do not disclose a new portable steam bath assembly. The inventive device includes a frame, side and rear panels, a floor assembly, an outer cover, and a steam generating assembly.

In these respects, the portable steam bath assembly according to the present invention substantially departs from the conventional concepts and designs of the prior art, and in so doing provides an apparatus primarily developed for the purpose of providing an easily assembled lightweight portable steam bath assembly device.

SUMMARY OF THE INVENTION

In view of the foregoing disadvantages inherent in the known types of steam bath devices now present in the prior art, the present invention provides a new portable steam bath assembly construction wherein the same can be utilized for providing an easily assembled lightweight portable steam bath assembly device.

The general purpose of the present invention, which will be described subsequently in greater detail, is to provide a new portable steam bath assembly apparatus and method which has many of the advantages of the steam bath devices mentioned heretofore and many novel features that result in a new portable steam bath assembly which is not anticipated, rendered obvious, suggested, or even implied by any of the prior art steam bath devices, either alone or in any combination thereof.

To attain this, the present invention generally comprises a frame, side and rear panels, a floor assembly, an outer cover, and a steam generating assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable steam bath assembly apparatus and method which has many of the advantages of the steam bath devices mentioned heretofore and many novel features that result in a new portable steam bath assembly which is not anticipated, rendered obvious, suggested, or even implied by any of the prior art steam bath devices, either alone or in any combination thereof.

It is another object of the present invention to provide a new portable steam bath assembly that may be easily and efficiently manufactured and marketed.

It is a further object of the present invention to provide a new portable steam bath assembly that is of a durable and reliable construction.

An even further object of the present invention is to provide a new portable steam bath assembly which is susceptible of a low cost of manufacture with regard to both materials and labor, and which accordingly is then susceptible of low prices of sale to the consuming public, thereby making such portable steam bath assembly economically available to the buying public.

Still yet another object of the present invention is to provide a new portable steam bath assembly which provides in the apparatuses and methods of the prior art some of the advantages thereof, while simultaneously overcoming some of the disadvantages normally associated therewith.

Still another object of the present invention is to provide a new portable steam bath assembly for providing an easily assembled lightweight portable steam bath assembly device.

Yet another object of the present invention is to provide a new portable steam bath assembly which includes a frame, side and rear panels, a floor assembly, an outer cover, and a steam generating assembly.

Still yet another object of the present invention is to provide a new portable steam bath assembly that permits a user to easily move the steam bath assembly to various locations throughout a dwelling without substantial heavy lifting.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
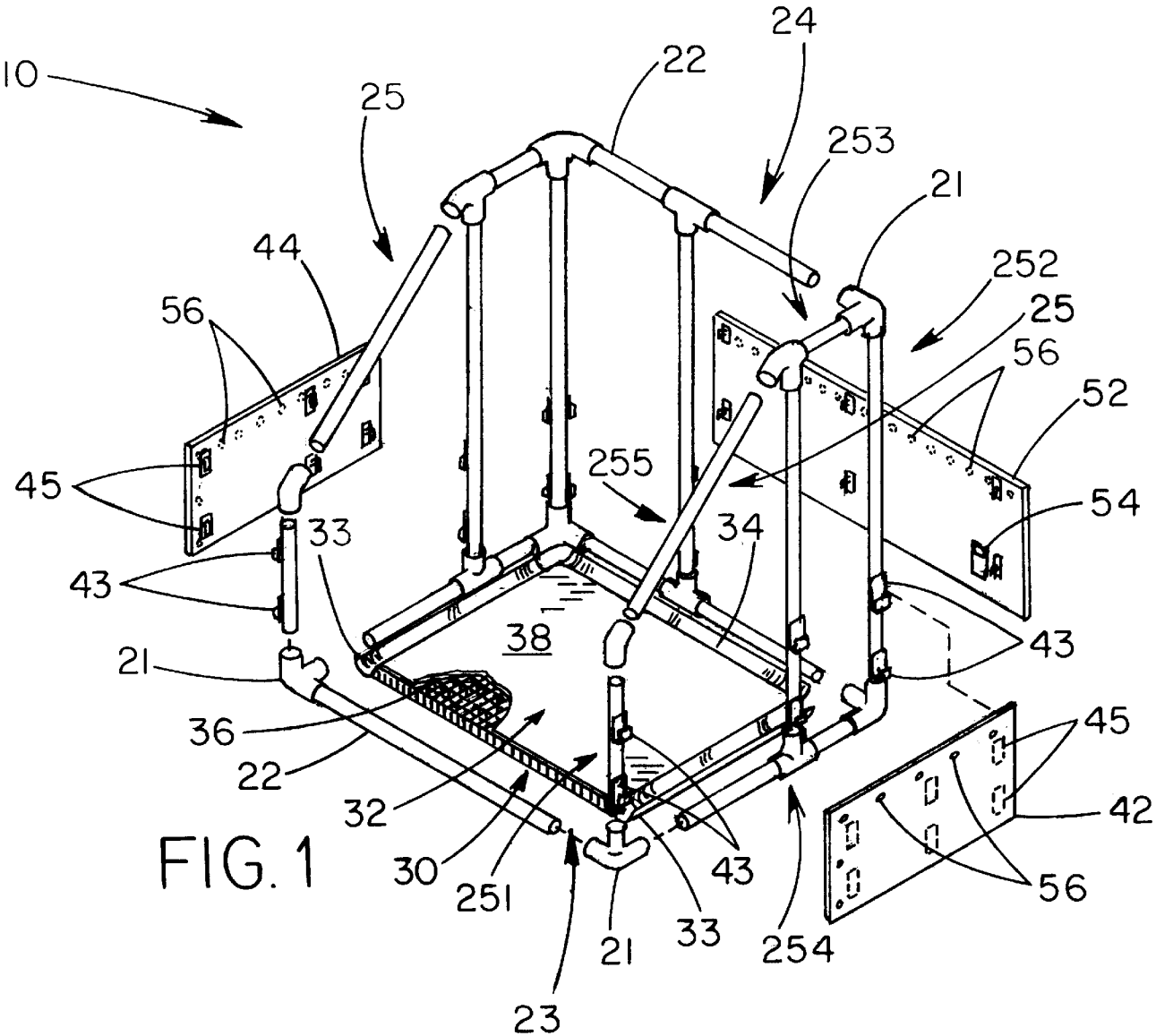
FIG. 1 is an exploded view of the frame, panels and floor assembly of a new portable steam bath assembly according to the present invention.
Figure 2:
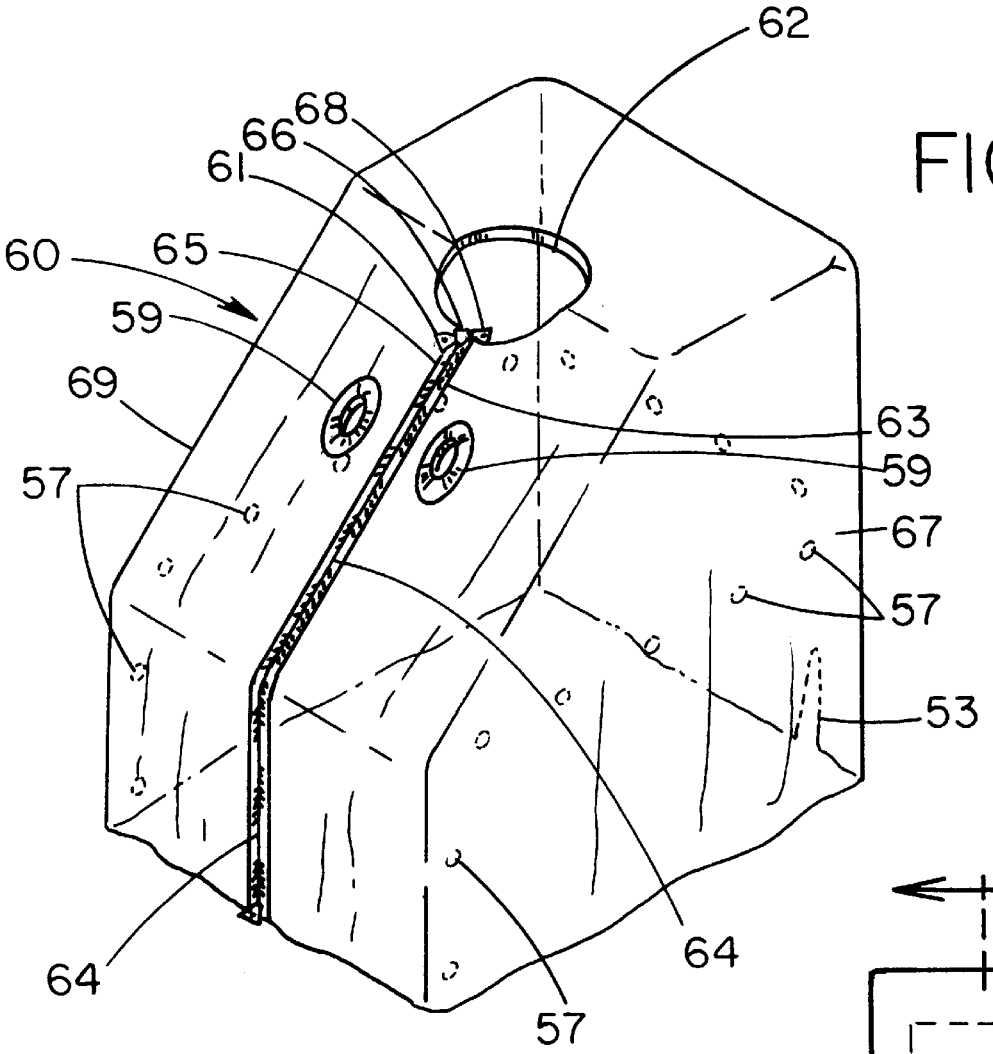
FIG. 2 is a perspective view of the cover of the present invention.
Figure 3:
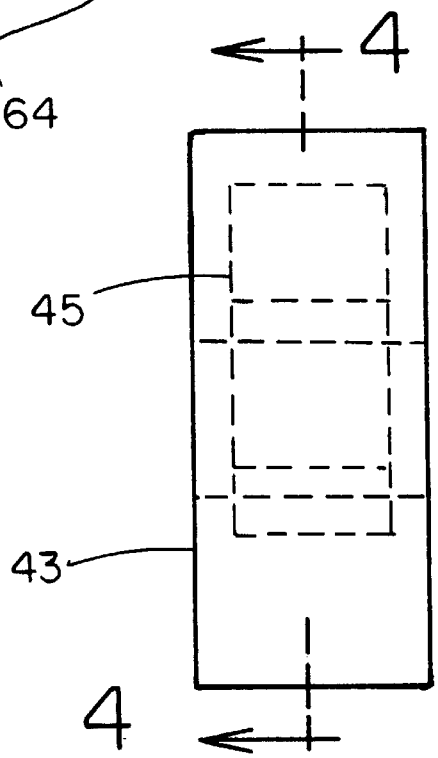
FIG. 3 is a front view of the clip members of the present invention.
Figure 4:
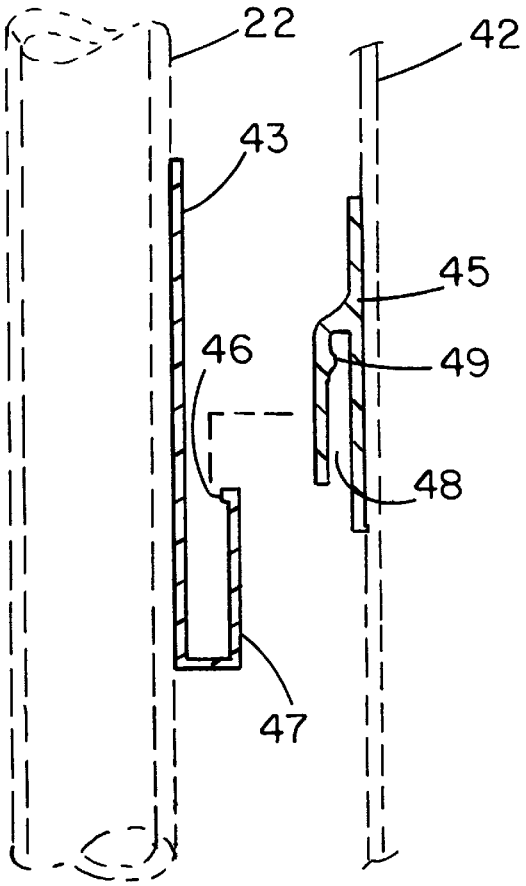
FIG. 4 is a cross-sectional view of the clip members of the present invention taken along line 4—4 of FIG. 3.
Figure 6:
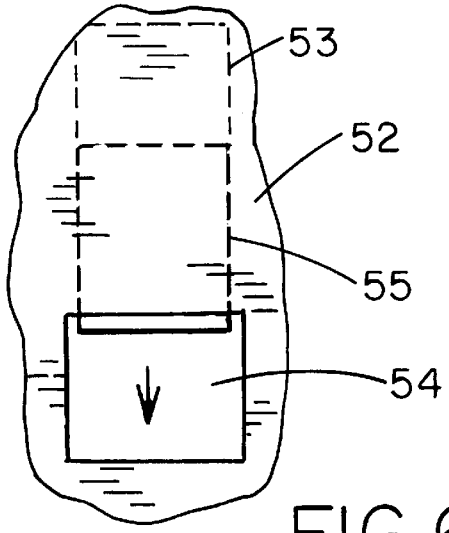
FIG. 6 is a front view of the aperture in the rear panel of the present invention.
Figure 5:
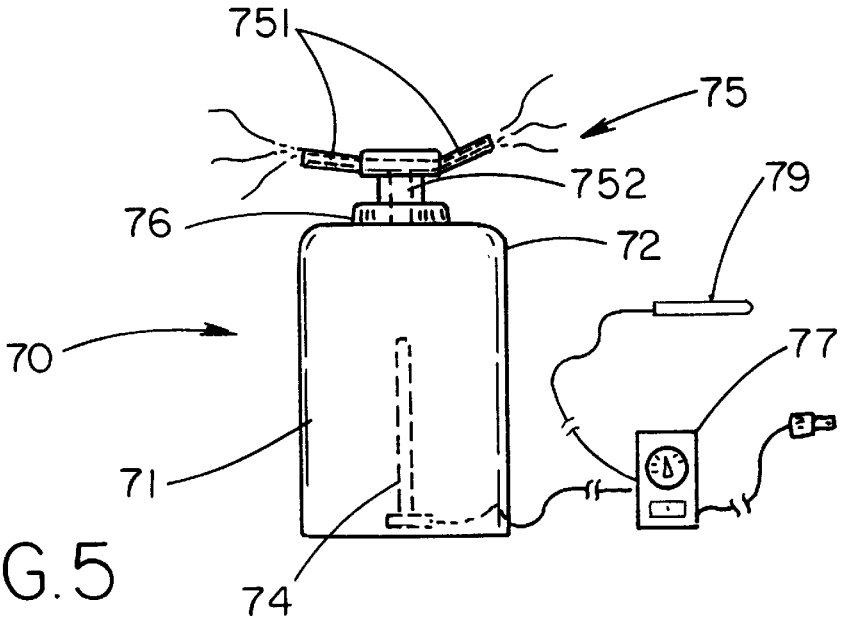
FIG. 5 is a front view of the steam generating assembly of the present invention.

With reference now to the drawings, and in particular to FIGS. 1 through 5 thereof, a new portable steam bath assembly embodying the principles and concepts of the present invention and generally designated by the reference numeral 10 will be described.

As best illustrated in FIGS. 1 through 5, the portable steam bath assembly 10 generally comprises a frame 20, a floor assembly 30 positionable within the frame 20, a pair of side panels 42 and 44 for coupling to opposite sides of the frame 20, a rear panel 52 for coupling to a rear of the frame 20, a cover 60 for positioning over the frame 20, and a steam generating assembly 70 for providing steam to the interior space of the covered frame 20.

The cover 60 has a head opening 62 designed for positioning around a user's neck such that a head of the user is positionable outside the cover 60 when the user is positioned within the covered frame 20. The cover 60 further has a portal slot 64 having opposing sides 67 and 69 engageable to each other to define a closed condition and separable from each other to define an open condition. The portal slot 64 is designed for permitting the user to enter the covered frame 20 when the portal slot 64 is in the open condition, the portal slot 64 further is designed to be closable by the user when the user is positioned within the covered frame 20. The preferred structure to permit closing of the portal slot 64 from inside or outside the covered frame 20 is to provide the opposing sides 67 and 69 with complementary zipper portions 63 and 65 for engaging the opposing sides 67 and 69 to each other. A zipper actuator 66 for engaging and disengaging the zipper portions 63 and 65 includes a pair of manipulation tabs 61 and 68 for sliding the zipper actuator 66 along the zipper portions 63 and 65. Manipulation tab 68 is positioned on an inside of the cover 60 for accessibility from within the covered frame 20 and manipulation tab 61 is positioned on an outside of the cover 60 for accessibility from outside the covered frame 20.

In a most preferred embodiment, the cover 60 has a pair of hand openings 59 designed for insertion of a hand of the user therethrough for permitting handling of an item outside the cover 60 while the user is positioned in the covered frame 20. Thus the user can easily hold a book outside the covered frame for reading while steaming is taking place.

The frame 20 includes a plurality of pipe members 22 joined together by a plurality of joint members 21 to form a bottom face 23, a back face 24 and two opposing side faces 25. Each of the side faces 25 is generally pentagonal and includes a front side 251 and a back side 252 extending substantially parallel to each other, a top side 253 and a bottom side 254 extending substantially parallel to each other and substantially perpendicular with respect to the front side 251 and the back side 252. Each side face 25 also includes an angled side 255 extending between the front side 251 and the top side 253.

The side panels 42 and 44 and the rear panel 52 are attached to the frame 20 using a plurality of first and second clip members 43 and 45. Each first clip member 43 is engageable to a respective second clip member 45 for removably coupling the side panels 42 and 44 and the rear panel 52 to the frame 20. Most preferably, each of the side panels 42 and 44 and the rear panel 52 has a plurality of first clip members 43 coupled thereto and the frame 20 has a plurality of corresponding second clip members 45. The second clip members 45 are arranged for engaging the first clip members 43 of the side panels 42 and 44 and the rear panel 52 whereby the side panels 42 and 44 and the rear panel 52 are engageable to the frame 20.

Each first clip member 43 is substantially U-shaped and has a locking member 46 extending from a distal end of an outer flange 47 of the first clip member 43 when the first clip member 43 is coupled to the frame 20. The locking member 46 is designed to extend inwardly towards the frame 20 when the first clip member 43 is coupled to the frame 20.

Each second clip member 45 is configured to have a receiving portion 48 generally shaped to receive the outer flange 47 of the first clip member 43. The receiving portion 48 further has a protrusion 49 for removably engaging the locking member 46 when the outer flange 47 is inserted into the receiving portion 48.

For attaching the cover 60 to the frame 20, each of the side panels 42 and 44 and the rear panel 52 has a plurality of snap members 56 coupled thereto. The cover 60 has a plurality of corresponding snap members 57 coupled thereto for engaging the plurality of snap members 56 of the side panels 42 and 44 and the rear panel 52. Each snap member 56 is positioned to engage a respective one of the corresponding snap members 57 when the cover 60 is positioned around the frame 20.

The floor assembly 30 has a central portion 32 having two side troughs 33 and a rear trough 34 extending therefrom. Each of the side troughs 33 and the rear trough 34 is designed for receiving a portion of the frame 20 therein for preventing movement of the frame 20 relative to the floor assembly 30. The central portion 30 has a grating 36 and a substantially continuous planar covering 38 over the grating 36 for providing a comfortable surface for the user's feet. The grating 36 is for providing lightweight strengthening and durability to the floor assembly 30.

The steam generating assembly 70 includes a housing 72 with an interior reservoir 71 for holding a supply of water, a heating element 74 positioned within the interior reservoir 71, a dispersion assembly 75 positioned above the interior reservoir 71, a thermostat 77 operationally connected to the heating element 74, and a temperature probe 79 operationally connected to the thermostat 77. The steam generating assembly 70 is preferably powered by a cord attachable to a standard electrical outlet. The rear panel 53 includes an aperture 54 for facilitating connection of the power cord to the outlet when the steam generating unit 70 is within the covered frame 20. The aperture is coverable using a sliding door 55 positioned adjacent to the aperture 54. The cover 60 also includes a slot 53 positioned adjacent the aperture 54.

The heating element 74 is for converting the supply of water into steam. The dispersion assembly 75 is designed to be in environmental communication with the interior reservoir 71 for dispersing the steam generated by the heating element 74. The thermostat 77 is designed for actuating the heating element 74 when an ambient temperature sensed by the temperature probe 79 is less than a selectable temperature setting of the thermostat 77.

The dispersion assembly 75 includes a pair of dispersion tubes 751 extending outwardly from opposite sides of a rotatable central duct 752. The central duct 752 is coupled to a lid 76 designed for coupling to a top of the housing 72.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A steam bath assembly comprising:

a frame;

a floor assembly positionable within said frame;

a pair of side panels, said side panels being for coupling to opposite sides of said frame;

a rear panel, said rear panel being for coupling to a rear of said frame, a cover for positioning over said frame to form a covered frame having an interior space, said cover having a head opening adapted for positioning around a user's neck such that a head of the user is positionable outside said cover when the user is positioned within said interior space, said cover further including a portal slot, said portal slot having opposing sides engageable to each other to define a closed condition and separable from each other to define an open condition, said portal slot being adapted for permitting the user to enter said interior space when said portal slot is in said open condition, said slot further being adapted to be closable by the user when the user is positioned within said interior space;

a steam generating assembly for positioning within said covered frame for providing steam to said interior space; and a plurality of first and second clip numbers each first clip member being engageable to a respective second clip member, said first and second clip members being for removably coupling said side panels and said rear panel to said frame, each of said side panels and said rear panel having a plurality of clip members coupled thereto, said frame having a plurality of corresponding clip members coupled thereto and arranged for engaging said clip members of said side panels and said rear panel whereby said side panels and said rear panel are engageable to said frame, wherein each of said first clip members has a U-shaped portion and each of said second clip members has a U-shaped configuration for permitting releasable interlocking of the first and second clip members together.

2. The steam bath assembly of claim 1, wherein said frame further comprises:

a plurality of pipe members, said pipe members being joined together by a plurality of joint members to form a bottom face, a back face and two opposing side faces;

wherein each of said side faces is generally pentagonal, wherein each of said side faces has a front side and a back side, said front side and said back side extending substantially parallel to each other, wherein each of said side faces has a top side and a bottom side, said top side and said bottom side extending substantially parallel to each other and substantially perpendicular with respect to said front side and said back side, wherein each of said side faces has an angled side extending between said front side and said top side.

3. The steam bath assembly of claim 1, further comprising:

each of said side panels and said rear panel including a plurality of snap members coupled thereto; and said cover having a plurality of corresponding snap members coupled thereto for engaging said plurality of snap members of said side panels and said rear panel, each said snap member being positioned to engage a respective one of said corresponding snap members when said cover is positioned around said frame whereby said cover is removably engageable to said side panels and said rear panel.

4. The steam bath assembly of claim 1 further comprising:

said floor assembly including a central portion, said central portion having a two side troughs and a rear trough extending therefrom, each of said side troughs and said rear trough being for receiving a portion of said frame therein for preventing movement of said frame relative to said floor assembly; and said central portion having a grating and a substantially continuous planar covering over said grating, said grating being for providing lightweight strengthening to said floor assembly.

5. The steam bath assembly of claim 1, further comprising:

said cover having a pair of hand openings therein, said hand openings being adapted for insertion of a hand of the user therethrough for permitting handling of an item outside the cover while the user is positioned in said interior space.

6. The steam bath assembly of claim 1, further comprising:

said opposing sides of said portal slot each having a complementary zipper portions coupled thereto for engaging said opposing sides to each other; and a zipper actuator for engaging and disengaging said zipper portions to and from each other.

7. The steam bath assembly of claim 6, further comprising:

said zipper actuator having a pair of manipulation tabs for sliding said zipper actuator along said zipper portions, one of said manipulation tabs being positioned for accessibility from within said interior space, the other of said manipulation tabs being positioned for accessibility from outside said cover.

8. The steam bath assembly of claim 1, wherein said steam generating assembly further comprises:

a housing having an interior reservoir, said interior reservoir for holding a supply of water;

a heating element positioned within said interior reservoir, said heating element being for converting said supply of water into steam;

a dispersion assembly positioned above said interior reservoir and in environmental communication with said interior reservoir for dispersing said steam generated by said heating element;

a thermostat operationally connected to said heating element; and a temperature probe operationally connected to said thermostat, said thermostat being for actuating said heating element when an ambient temperature sensed by said temperature probe is less than a selectable temperature setting of said thermostat.

9. The steam bath assembly of claim 8, wherein said dispersion assembly further comprises:

a pair of dispersion tubes extending outwardly from opposite sides of a rotatable central duct;

said central duct being coupled to a lid, said lid being for coupling to a top of said housing.

10. The steam bath assembly of claim 1, wherein each first clip member has a locking member extending from a distal end of an outer flange of said first clip member when said first clip member is coupled to said frame, said locking member extending inwardly towards said frame; and each second clip member being configured to have a receiving portion generally shaped to receive said outer flange of said first clip member, said receiving portion further having a protrusion for removably engaging said locking member whereby said second clip member is engaged to said first clip member.

11. A steam bath assembly comprising:

a frame;

a floor assembly positionable within said frame;

a pair of side panels, said side panels being for coupling to opposite sides of said frame;

a rear panel, said rear panel being for coupling to a rear of said frame;

a cover for positioning over said frame to form a covered frame having an interior space, said cover having a head opening adapted for positioning around a user's neck such that a head of the user is positionable outside said cover when the user is positioned within said interior space, said cover further including a portal slot, said portal slot having opposing sides engageable to each other to define a closed condition and separable from each other to define an open condition, said portal slot being adapted for permitting the user to enter said interior space when said portal slot is in said open condition, said slot further being adapted to be closable by the user when the user is positioned within said interior space;

a steam generating assembly for positioning within said covered frame for providing steam to said interior space;

wherein said frame further includes a plurality of pipe members, said pipe members being joined together by a plurality of joint members to form a bottom face, a back face and two opposing side faces, and wherein each of said side faces is generally pentagonal, wherein each of said side faces has a front side and a back side, said front side and said back side extending substantially parallel to each other, wherein each of said side faces has a top side and a bottom side, said top side and said bottom side extending substantially parallel to each other and substantially perpendicular with respect to said front side and said back side, wherein each of said side faces has an angled side extending between said front side and said top side;

a plurality of first and second clip members, each first clip member being engageable to a respective second clip member, said first and second clip members being for removably coupling said side panels and said rear panel to said frame, each of said side panels and said rear panel having a plurality of first clip members coupled thereto, said frame having a plurality of corresponding second clip members coupled thereto and arranged for engaging said first clip members of said side panels and said rear panel whereby said side panels and said rear panel are engageable to said frame;

each of said side panels and said rear panel including a plurality of snap members coupled thereto;

said cover having a plurality of corresponding snap members coupled thereto for engaging said plurality of snap members of said side panels and said rear panel, each said snap member being positioned to engage a respective one of said corresponding snap members when said cover is positioned around said frame whereby said cover is removably engageable to said side panels and said rear panel;

said floor assembly including a central portion, said central portion having a two side troughs and a rear trough extending therefrom, each of said side troughs and said rear trough being for receiving a portion of said frame therein for preventing movement of said frame relative to said floor assembly;

said central portion having a grating and a substantially continuous planar covering over said grating, said grating being for providing lightweight strengthening to said floor assembly;

said cover having a pair of hand openings therein, said hand openings being adapted for insertion of a hand of the user therethrough for permitting handling of an item outside the cover while the user is positioned in said interior space;

said opposing sides of said portal slot each having a complementary zipper portions coupled thereto for engaging said opposing sides to each other;

a zipper actuator for engaging and disengaging said zipper portions to and from each other;

said zipper actuator having a pair of manipulation tabs for sliding said zipper actuator along said zipper portions, one of said manipulation tabs being positioned for accessibility from within said interior space, the other of said manipulation tabs being positioned for accessibility from outside said cover;

wherein said steam generating assembly further includes a housing having an interior reservoir, said interior reservoir for holding a supply of water, a heating element positioned within said interior reservoir, said heating element being for converting said supply of water into steam, a dispersion assembly positioned above said interior reservoir and in environmental communication with said interior reservoir for dispersing said steam generated by said heating element, a thermostat operationally connected to said heating element; and a temperature probe operationally connected to said thermostat, said thermostat being for actuating said heating element when an ambient temperature sensed by said temperature probe is less than a selectable temperature setting of said thermostat, a pair of dispersion tubes extending outwardly from opposite sides of a rotatable central duct, and said central duct being coupled to a lid, said lid being for coupling to a top of said housing;

each first clip member being substantially U-shaped, each first clip member further having a locking member extending from a distal end of an outer flange of said first clip member when said first clip member is coupled to said frame, said locking member extending inwardly towards said frame; and each second clip member being configured to have a receiving portion generally shaped to receive said outer flange of said first clip member, said receiving portion further having a protrusion for removably engaging said locking member whereby said second clip member is engaged to said first clip member.

12. A steam bath assembly comprising:

a frame;

a floor assembly positionable within said frame;

a pair of side panels, said side panels being for coupling to opposite sides of said frame;

a rear panel, said rear panel, being for coupling to a rear of said frame;

a cover for positioning over said frame to form a covered frame having an interior space, said cover having a head opening adapted for positioning around a user's neck such that a head of the user is positionable outside said cover when the user is positioned within said interior space said cover further including a portal slot, said portal slot having opposing sides engageable to each other to define a closed condition and separable from each other to define an open condition, said portal slot being adapted for permitting the user to enter said interior space when said portal slot is in said open condition, said slot further being adapted to be closable by the user when the user is positioned within said interior space;

a steam generating assembly for positioning within said covered frame for providing steam to said interior space;

a plurality of first and second clip members, each first clip member being engageable to a respective second clip member, said first and second clip members being for removably coupling said side panels and said rear panel to said frame, each of said side panels and said rear panel having a plurality of first clip members coupled thereto, said frame having a plurality of corresponding second clip members coupled thereto and arranged for engaging said first clip members of said side panels and said rear panel whereby said side panels and said rear panel are engageable to said frame; and a plurality of pipe members, said pipe members being joined together by a plurality of joint members to form a bottom face, a back face and two opposing side faces;

wherein each of said side faces is generally pentagonal, wherein each of said side faces has a front side and a back side, said front side and said back side extend substantially parallel to each other, wherein each of said side faces has a top side and a bottom side, said top side and said bottom side extending substantially parallel to each other and substantially perpendicular with respect to said front side and said back side, wherein each of said side faces has an angled side extending between said front side and said top side.

13. The steam bath assembly of claim 12, further comprising:

each of said side panels and said rear panel including a plurality of snap members coupled thereto; and said cover having a plurality of corresponding snap members coupled thereto for engaging said plurality of snap members of said side panels and said rear panel, each said snap member being positioned to engage a respective one of said corresponding snap members when said cover is positioned around said frame whereby said cover is removably engageable to said side panels and said rear panel.

14. The steam bath assembly of claim 12, further comprising:

said floor assembly including a central portions said central portion having a two side troughs and a rear trough extending therefrom, each of said side troughs and said rear trough being for receiving a portion of said frame therein for preventing movement of said frame relative to said floor assembly; and said central portion having a grating and a substantially continuous planar covering over said grating, said grating being for providing lightweight strengthening to said floor assembly.

15. The steam bath assembly of claim 12, further comprising:

said cover having a pair of hand openings therein, said hand openings being adapted for insertion of a hand of the user therethrough for permitting handling of an item outside the cover while the user is positioned in said interior space.

16. The steam bath assembly of claim 12, further comprising:

said opposing sides of said portal slot each having a complementary zipper portions coupled thereto for engaging said opposing sides to each other; and a zipper actuator for engaging and disengaging said zipper portions to and from each other.

17. The steam bath assembly of claim 16, further comprising:

said zipper actuator having a pair of manipulation tabs for sliding said zipper actuator along said zipper portions, one of said manipulation tabs being positioned for accessibility from within said interior space, the other of said manipulation tabs being positioned for accessibility from outside said cover.

18. The steam bath assembly of claim 12, wherein said steam generating assembly further comprises:

a housing having an interior reservoir, said interior reservoir for holding a supply of water;

a heating element positioned within said interior reservoir, said heating clement being for converting said supply of water into steam;

a dispersion assembly positioned above said interior reservoir and in environmental communication with said interior reservoir for dispersing said steam generated by said heating element:

a thermostat operationally connected to said heating element; and a temperature probe operationally connected to said thermostat, said thermostat being for actuating said heating element when an ambient temperature sensed by said temperature probe is less than a selectable temperature setting of said thermostat.

19. The steam bath assembly of claim 18, wherein said dispersion assembly further comprises:

a pair of dispersion tubes extending outwardly from opposite sides of a rotatable central duct:

said central duct being coupled to a lid, said lid being for coupling to a top of said housing.

20. The steam bath assembly of claim 12, further comprising;

each first clip member being substantially U-shaped, each first clip member further having a locking member extending from a distal end of an outer flange of said first clip member when said first clip member is coupled to said frame, said locking member extending inwardly towards said frame; and each second clip member being configured to have a receiving portion generally shaped to receive said outer flange of said first clip member, said receiving portion further having a protrusion for removably engaging said locking member whereby said second clip member is engaged to said first clip member.

* * * * *